US009427021B2

(12) United States Patent
Zitturi et al.

(10) Patent No.: US 9,427,021 B2
(45) Date of Patent: Aug. 30, 2016

(54) CIGARETTE PAPER WITH HOMOGENEOUS VISUAL IMPRESSION

(71) Applicant: delfortgroup AG, Traun (AT)

(72) Inventors: Roland Zitturi, Innsbruck (AT); Irene Rohregger, Telfs (AT); Maria Gleinser, Wattens (AT)

(73) Assignee: delfortgroup AG, Traun (AT)

( * ) Notice: Subject to any disclaimer, the term of this patent is extended or adjusted under 35 U.S.C. 154(b) by 0 days.

(21) Appl. No.: 14/636,796

(22) Filed: Mar. 3, 2015

(65) Prior Publication Data

US 2015/0173416 A1 Jun. 25, 2015

Related U.S. Application Data

(63) Continuation of application No. PCT/EP2013/002235, filed on Jul. 29, 2013.

(30) Foreign Application Priority Data

Sep. 5, 2012 (DE) ..... 10 2012 108 255

(51) Int. Cl.
*A24D 1/02* (2006.01)
*D21H 17/67* (2006.01)
(Continued)

(52) U.S. Cl.
CPC ..... *A24D 1/025* (2013.01); *A24D 1/02* (2013.01); *D21H 17/675* (2013.01); *D21H 19/36* (2013.01); *D21H 19/66* (2013.01); *D21H 19/68* (2013.01); *D21H 21/28* (2013.01); *D21H 27/00* (2013.01); *D21H 27/02* (2013.01); *D21H 27/08* (2013.01)

(58) Field of Classification Search
USPC ..... 162/139, 162, 158, 181.1–181.9; 131/352, 365
See application file for complete search history.

(56) References Cited

U.S. PATENT DOCUMENTS

| | | | | |
|---|---|---|---|---|
| 4,020,850 | A | 5/1977 | Cogbill, II | 131/15 R |
| 2004/0231685 | A1 | 11/2004 | Patel et al. | 131/365 |

FOREIGN PATENT DOCUMENTS

| | | | |
|---|---|---|---|
| EP | 0 870 871 | 10/1998 | D21H 17/67 |
| WO | WO 02/24006 | 3/2002 | A24D 1/02 |
| WO | WO 2011/042354 | 4/2011 | A24C 5/47 |

OTHER PUBLICATIONS

International Bureau, International Preliminary Report on Patentability, International Application No. PCT/EP2013/002235, dated Mar. 10, 2015, together with the written opinion of the International Searching Authority, 6 pages.
(Continued)

*Primary Examiner* — Dennis Cordray
(74) *Attorney, Agent, or Firm* — Sunstein Kann Murphy & Timbers LLP

(57) ABSTRACT

The invention relates to a cigarette paper onto which a composition is applied in the form of a pattern which has a Tamura coarseness of at most 0.22 mm, preferably at most 0.2 mm. According to ISO 2470-1 the absolute difference in whiteness between an area of the cigarette paper over the whole of which the composition is applied and an area of the cigarette paper onto which the composition is not applied is at least 25% in the dry state, preferably at least 35% and particularly preferably at least 40% and at most 60%, preferably at most 55%. Furthermore, the opacity according to ISO 2471 of an area of the cigarette paper over the whole of which this composition is applied is higher, when the composition is in the dry state, than the opacity of an area onto which this composition is not applied.

33 Claims, 3 Drawing Sheets

(51) Int. Cl.

| | |
|---|---|
| ***D21H 19/68*** | (2006.01) |
| ***D21H 21/28*** | (2006.01) |
| ***D21H 27/02*** | (2006.01) |
| ***D21H 27/08*** | (2006.01) |
| ***D21H 27/00*** | (2006.01) |
| ***D21H 19/36*** | (2006.01) |
| ***D21H 19/66*** | (2006.01) |

(56) References Cited

OTHER PUBLICATIONS

International Bureau, International Preliminary Report on Patentability, International Application No. PCT/EP2013/002235, dated Mar. 19, 2015, together with the written opinion of the International Searching Authority, 6 pages. [English Translation].

International Searching Authority, International Search Report, International Application No. PCT/EP2013/002235, dated Oct. 10, 2013, together with the Written Opinion, 11 pages.

| No. | Pattern | a | b | c | Coverage | Coarseness | |
|---|---|---|---|---|---|---|---|
| | | [mm] | [mm] | [mm] | [%] | [pixel] | [mm] |
| 1 | Fig. 1 | 0.1 | 0.2 | - | 33.3 | 7.267 | 0.0727 |
| 2 | Fig. 1 | 0.1 | 0.5 | - | 16.7 | 12.933 | 0.1293 |
| 3 | Fig. 1 | 0.3 | 0.5 | - | 37.5 | 19.600 | 0.1960 |
| 4 | Fig. 1 | 0.3 | 1.0 | - | 23.1 | 29.369 | 0.2937 |
| 5 | Fig. 1 | 0.3 | 1.4 | - | 17.6 | 36.671 | 0.3667 |
| 6 | Fig. 1 | 0.5 | 0.5 | - | 50.0 | 25.000 | 0.2500 |
| 7 | Fig. 1 | 0.5 | 1.0 | - | 33.3 | 36.120 | 0.3612 |
| 8 | Fig. 2 | 0.1 | 0.2 | - | 55.6 | 6.289 | 0.0629 |
| 9 | Fig. 2 | 0.1 | 0.5 | - | 30.6 | 9.460 | 0.0946 |
| 10 | Fig. 2 | 0.3 | 0.5 | - | 60.9 | 17.789 | 0.1779 |
| 11 | Fig. 2 | 0.3 | 1.0 | - | 40.8 | 22.588 | 0.2259 |
| 12 | Fig. 2 | 0.3 | 1.4 | - | 32.2 | 26.989 | 0.2699 |
| 13 | Fig. 2 | 0.5 | 0.5 | - | 75.0 | 30.777 | 0.3078 |
| 14 | Fig. 2 | 0.5 | 1.0 | - | 55.6 | 31.200 | 0.3120 |
| 15 | Fig. 3 | 0.4 | 0.5 | - | 49.8 | 10.439 | 0.1044 |
| 16 | Fig. 3 | 0.4 | 0.7 | - | 26.8 | 20.789 | 0.2079 |
| 17 | Fig. 3 | 0.4 | 0.8 | - | 20.5 | 27.061 | 0.2706 |
| 18 | Fig. 3 | 0.4 | 1.0 | - | 13.1 | 38.651 | 0.3865 |
| 19 | Fig. 4 | 0.25 | 1.0 | 1.0 | 40.7 | 16.848 | 0.1685 |
| 20 | Fig. 4 | 0.25 | 1.5 | 2.0 | 27.1 | 25.653 | 0.2565 |
| 21 | Fig. 4 | 0.25 | 2.0 | 2.0 | 20.3 | 31.891 | 0.3189 |
| 22 | Fig. 5 | 0.25 | 1.0 | - | 59.4 | 17.320 | 0.1732 |
| 23 | Fig. 5 | 0.25 | 2.0 | - | 35.3 | 29.630 | 0.2963 |
| 24 | Fig. 6 | 0.8 | 5.0 | - | 19.7 | 13.423 | 0.1342 |
| 25 | Fig. 6 | 1.2 | 8.0 | - | 18.4 | 26.684 | 0.2668 |
| 26 | Fig. 6 | 1.8 | 10.0 | - | 17.8 | 33.659 | 0.3366 |
| 27 | Fig. 1 | 0.25 | 0.25 | - | 50.0 | 12.520 | 0.1252 |

Fig. 7

CIGARETTE PAPER WITH HOMOGENEOUS VISUAL IMPRESSION

CROSS-REFERENCE TO RELATED APPLICATIONS

This application is a continuation of PCT Patent Application No. PCT/EP2013/002235 filed Jul. 29, 2013 which itself claims priority to German Patent Application Ser. No. 10 2012 108 255.3 filed Sep. 5, 2012. The entire contents of each of these applications are herein incorporated by reference.

FIELD OF THE INVENTION

The present invention relates to a cigarette paper and a corresponding production process. In particular it relates to a cigarette paper, for which the visibility of inhomogeneities in whiteness and the opacity of the paper is reduced for the human eye, so that the tobacco rod of a cigarette manufactured from this paper conveys a homogeneous visual impression.

BACKGROUND AND PRIOR ART

A cigarette typically consists of a cylindrical tobacco rod, which is wrapped with a cigarette paper, and beyond that optionally contains a filter plug wrapped with a plug wrap paper, which is connected to the tobacco rod by a tipping paper.

It is generally known that the smoker judges a cigarette not only according to its taste during smoking but also by its visual qualities. In particular, a visually homogeneous tobacco rod is considered to be an indication of a high quality cigarette brand, a so called "premium brand". This can in general mean that the tobacco rod wrapped with the cigarette paper is, visually homogeneous, opaque and white when viewed from the outside, so that tobacco particles of the tobacco rod are not discernible through the paper as a variation in the whiteness.

In order to produce such a visually homogeneous cigarette paper, various means from the prior art are at the disposal of the paper manufacturer. For example, it is known that by increasing the basis weight of the paper, by increasing the quantity of fillers, by the selection of the filler or other measures, the homogeneity of the paper can be improved. All these measures can in fact increase the opacity of the cigarette paper according to ISO 2471 or the whiteness according to ISO 2470-1, but removal of the inhomogeneities is inadequate. It is in the nature of the paper production process that the visual impression of a white paper viewed with backlighting differs substantially from that of a white plastic film by inhomogeneities in the opacity. This overall inhomogeneous visual impression which a paper sheet conveys when viewed under transmitted light is called "formation" or "mottling". The skilled person typically assesses the formation of the paper subjectively; if the paper sheet is optically homogeneous, its formation is said to be good.

In some cases, such inhomogeneity is desired to a small extent in order to provide the paper with a naturalistic effect and, for example, to make it distinguishable from a plastic film. In other applications, such as on the cigarette, a high visual homogeneity is valued. In Asiatic regions especially, for example, the smoker does not want to be able to discern the tobacco as variations in brightness at some positions through the cigarette paper. This effect is more pronounced the thinner and lighter the cigarette paper and the lower the filler content.

An important visual property of the cigarette paper is its opacity, that is, the opaqueness of the cigarette paper. It is determined according to ISO 2471 and is expressed as percentage from 0% (transparent) to 100% (completely opaque).

Typical cigarette papers are pale grey to white, although black cigarette papers and coloured cigarette papers are also available on the market. The whiteness of the cigarette paper is therefore also an important visual characteristic and is determined according to ISO 2470-1. It is also quantified as a percentage with a value of 0% (black) to 100% (white) in comparison to a white reference material. Values above 100% can be obtained using fluorescence; they are, however, only slightly over 100% and can mostly only be obtained in connection with optical brighteners.

In addition to the visual properties of a cigarette paper, those technical properties of the cigarette paper which can influence the components of the smoke of a cigarette manufactured therefrom play a role. These components are, for example, determined according to a method described in ISO 4387 and comprise, among others, the nicotine-free dry condensate ("tar"), the nicotine content and the quantity of carbon monoxide in the smoke of a cigarette.

An important such property of the cigarette paper is its air permeability. The air permeability is determined according to ISO 2965 and specifies which volume of air flows through the cigarette paper per unit time, per unit area and per pressure difference, and thus it has the dimension $cm^3/(min\ cm^2\ kPa)$. It is often designated as the CORESTA Unit (CU), ($1\ CU=1\ cm^3/(min\ cm^2\ kPa)$). The air permeability determines, among others, how strongly the smoke is diluted during a puff by the air flowing through the cigarette paper into the tobacco rod.

Another important technical property is the diffusion capacity. It specifies the gas volume passing through the paper per unit time, per unit area and per concentration difference and thus it has the dimension $cm^3/(s\ cm^2)=cm/s$. The diffusion capacity of a cigarette paper for $CO_2$ can, for example, be determined with the $CO_2$ Diffusivity Meter from the company Sodim. The diffusion capacity determines, among others, the gas exchange through the cigarette paper between the tobacco rod and the environment by diffusion, while the cigarette is smouldering.

Treating sections of the cigarette paper with burn-retardant materials to thereby provide the cigarette with self-extinguishing properties is also known in the prior art. A test for determining the self-extinguishing properties is described in ISO 12863. This or very similar tests are also the subject of legal regulations in the USA, Canada, Australia and the European Union. The treated sections are frequently 5 mm to 7 mm wide bands, which are applied to the inside of the cigarette paper and extend in the circumferential direction on the cigarette. The bands obstruct the access of oxygen to the glowing cone of the smouldering cigarette and thus cause self-extinguishing. These strips are usually printed on the wire side of the cigarette, which is generally less suited to printing, instead of on the upper side, so that the printed side is facing the tobacco rod on the cigarette and the bands are less visible from the outside. Despite this, the bands are often detectable on the cigarette with the naked eye upon careful inspection. Together with the inevitable visual inhomogeneity of the paper due to the paper production, such bands formed from burn-retardant material also deteriorate the visual properties.

It has turned out to be difficult to remove said inhomogeneities in the visual appearance. An increase in the basis weight of the cigarette paper is limited by the smoker's acceptance of a cigarette manufactured from this paper, as the smoker primarily wants to smoke tobacco and not paper. Rather, there is a general desire to reduce the basis weight of the cigarette paper instead of increasing it. In addition, increasing the filler content impinges against limitations as the tensile strength of the paper is reduced too far and the paper is inclined to form dust during further processing. Further, with respect to the choice of the filler, there are legal and toxicological constraints. For example, titanium dioxide, particularly suitable for increasing whiteness and opacity, cannot be used in cigarette paper because of these limitations. The use of optical brighteners, although it might suggest itself technically, is excluded for cigarette papers for legal and toxicological reasons.

SUMMARY OF THE INVENTION

The objective of the present invention is to disclose a cigarette paper which improves the visual properties of a cigarette manufactured from this paper and in particular makes the visual inhomogeneity of the cigarette paper less perceptible to the human eye without essentially compromising the technical properties of the cigarette paper.

This objective is obtained by a cigarette paper according to claim 1 and a corresponding production process according to claim 18. Further advantageous embodiments are disclosed in the dependent claims.

According to the invention a composition is applied to the cigarette paper in form of a pattern, which has a Tamura coarseness which is at most 0.22 mm, preferably at most 0.20 mm. The absolute difference in whiteness according to ISO 2470-1 between an area of the cigarette paper to which the composition has been applied over the entire surface and an area of the cigarette paperto which the composition has not been applied is at least 25%, preferably at least 35% and particularly preferably at least 40%. It should, however, not exceed 60%, preferably 55%. Finally, the opacity according to ISO 2471 of an area of the cigarette paper to which the composition has been applied over the full surface is higher than the opacity of an area to which this composition has not been applied. The values for whiteness according to ISO 2470-1 and opacity according to ISO 2471 always refer to the composition in the dried state.

The inventors have surprisingly found that, contrary to expectations for white cigarette paper, for example, the visual quality can be improved by the application of compositions with a lower whiteness.

More precisely the inventors have found that patterns which satisfy certain requirements with respect to shape and colour can reduce the perceptibility of the inhomogeneities in the paper by the human eye. According to the invention, this pattern is produced by the application of a composition to the cigarette paper. By applying such a pattern, the areas in which the composition has been applied differ from the untreated areas of the cigarette paper with respect to whiteness and opacity. An improvement in the visual properties of the cigarette paper in terms of this invention is obtained if the aforementioned relationships exist between the whiteness, the opacity and the structural size of the pattern applied to the cigarette paper. Expressed simply, the effect according to the invention is obtained by applying a pattern to the cigarette paper which deviates somewhat in whiteness from the cigarette paper and is so finely structured that the smoker cannot perceive the structure of the pattern in detail from the distance from which he usually views a cigarette. Instead of perceiving the pattern, he sees only a slightly less white area than with conventional cigarette paper but which—surprisingly—appears visually substantially more homogeneous.

For this technical effect, as mentioned, it is necessary for the Tamura coarseness to be sufficiently small. A lower limit for the coarseness results essentially from practical considerations, since with the preferred printing processes, no arbitrarily small patterns can be printed. Consequently, in the preferred embodiments it will be at least 0.01 mm, preferably at least 0.05 mm.

For simplification of the description below, the following terms will be defined.

The printed area is defined as the area of the cigarette paper to which a composition according to the invention has been applied. Thus, it does not matter whether application of the composition is in fact by a printing process, but only that it has been applied by means of any process. This also encompasses spraying of the composition, for example.

The treated area is defined as the printed area complemented by a virtual edge around the printed area with a width of 1.5 mm. Formulated more precisely, the treated area is the combination of the area of all circles with a radius of 1.5 mm the center points of which are located in the printed area.

The unprinted area is defined as that fraction of the treated area which does not belong to the printed area.

The untreated area is defined as that area of the cigarette paper which does not belong to the treated area.

The visible cigarette paper area is defined as the area of the cigarette which is visible on the cigarette from the outside. Thus, it does not comprise, for example, the area which is overlapped by the tipping paper and also not the area of the cigarette paper which is overlapped by the formation of a seam of adhesive of a cigarette paper tube.

Various parameters can be used to describe the structural size of a pattern; they are determined by numerical calculations from a digital image of the pattern. A frequently used parameter, which corresponds well with human perception, is the so-called Tamura coarseness, which is described in H. Tamura, et al.: *Texture features corresponding to visual perception. IEEE Transactions on Systems, Man, and Cybernetics*, vol. SMC-8, no. 6, 1978, 406-473. Based on this, the algorithm for the determination of the Tamura coarseness will be described more precisely below.

A digital image of the print pattern is provided as the input data, in which a shade of grey is assigned to each pixel. The shades of grey are described in regularly ascending order by integers of 0 (black) to 255 (white). The resolution of the image is 0.01×0.01 mm per pixel. For repeated patterns with a rectangular repeat, the image shows at least one repeat, otherwise it shows the visible cigarette paper area. In the following description, it is assumed that the image has an extension of w pixels in the x-direction and h pixels in the y-direction orthogonal thereto. The x-direction corresponds to the circumferential direction on the cigarette and the y-direction is parallel to the longitudinal axis of the tobacco rod. The Tamura coarseness is not very direction-sensitive and in particular is not sensitive to an exchange of the x-direction and y-direction. Furthermore, it does not depend on the specific numerical values by which the shades of grey are characterized, but only upon the relationships to each other within the image.

The position of a pixel is described by the integer co-ordinates x and y with $0 \leq x < w$ and $0 \leq y < h$. Each pixel with co-ordinates (x,y) is assigned a shade of grey g(x,y). For values of x and y outside the given intervals, the relationship g(x,y)=g(x modulo w, y modulo h) holds, so that the image is considered to be repeated ad infinitum in every direction.

1. For each pixel (x,y), 101 values $G_{avg}(k,x,y)$ are calculated, which give the average shade of grey of a square with a side length of 2k+1, with k=0, 1, 2, . . . , 100, in the centre of which the pixel (x,y) is located, thus $$G_{avg}(k, x, y) = \frac{1}{(2k+1)^2} \sum_{i=x-k}^{x+k} \sum_{j=y-k}^{y+k} g(i, j)$$

2. For each pixel (x,y) and for each k=0, 1, 2, . . . , 100, the absolute difference $\Delta G_s(k,x,y)$, s=1, 2, 3, 4, in the average shade of grey to the four neighbouring non-overlapping squares is determined:

$$\Delta G_1(k,x,y)=|G_{avg}(k,x,y)-G_{avg}(k,x-2k-1,y)|$$

$$\Delta G_2(k,x,y)=|G_{avg}(k,x,y)-G_{avg}(k,x+2k+1,y)|$$

$$\Delta G_3(k,x,y)=|G_{avg}(k,x,y)-G_{avg}(k,x,y-2k-1)|$$

$$\Delta G_4(k,x,y)=|G_{avg}(k,x,y)-G_{avg}(k,x,y+2k+1)|$$

3. For each pixel (x,y) and for each k=0, 1, 2, . . . , 100, the maximum $\Delta G_{max}(k,x,y)$ of these values is determined:

$$\Delta G_{max}(k, x, y) = \max_{s=1,2,3,4} \Delta G_s(k, x, y)$$

4. For each pixel (x,y), that k is determined for which the value $\Delta G_{max}(k,x,y)$ is a maximum. This value will be called $K_{max}(x,y)=k$, that is, the following holds:

$$\Delta G_{max}(K_{max}(x, y), x, y) = \max_{k=1,2,\ldots,100} \Delta G_{max}(k, x, y)$$

If $\Delta G_{max}(k,x,y)$ acquires its maximum for several k, then $K_{max}(x,y)$ is the greatest k for which the maximum is acquired.

5. Over the entire image, the average value of $2 \cdot K_{max}(x,y)+1$ is determined. This average value is the Tamura coarseness, which is designated as $C_{Tamura}$:

$$C_{Tamuura} = 1 + \frac{2}{w \cdot h} \sum_{x=1}^{w} \sum_{y=1}^{h} K_{max}(x, y)$$

The coarseness has the unit "pixels" and can be converted by multiplying by the pixel size, in this case 0.01 mm per pixel. It is a measure of the mean structural size of the digital image. A size of 0.01 mm per pixel is sufficiently small for characterization of the patterns of the present invention, as smaller structures can be produced only with difficulty with the preferred application processes, particularly by gravure printing, and are also not needed for the effect according to the invention.

In the case that the image not only shows a rectangular repeat unit but the visible cigarette paper area, only those pixels which belong to the treated area are to be used for the averaging of step 5 of the above algorithm.

In accordance with the invention, the Tamura coarseness of the applied pattern as mentioned above is at most 0.22 mm, preferably at most 0.20 mm. The inventors have established that the desired effect can be obtained with patterns with a coarseness which acquires such low values. Investigations by the inventors have shown that this effect occurs for a plurality of different patterns at appropriately chosen coarseness values, of which some are shown below. For the effect according to the invention, the coarseness is therefore of essential importance, that is, independently of the specific design of the pattern.

According to the invention the whiteness of the printed area should be less than the whiteness of the unprinted area. The absolute difference in the whiteness according to ISO 2470-1 between the printed and the unprinted area is thus at least 25%, preferably at least 35% and particularly preferably at least 40%. At the same time, however, the difference should be at most 60%, preferably at most 55%, to avoid clearly perceptible differences.

The inventors have found that the effect according to the invention can be obtained over a comparatively large range of whiteness according to ISO 2470-1 and opacity according to ISO 2471 of the untreated cigarette paper. The effect, however, will be less pronounced if the whiteness as well as the opacity of the untreated cigarette paper are already very high and thus the visual quality of the untreated paper is already very good. Thus, in preferred embodiments, the area of the cigarette paper to which the composition is not applied should have a whiteness according to ISO 2470-1 of less than 95% or an opacity according to ISO 2471 of less than 90%.

In practice, a direct measurement of the whiteness according to ISO 2470-1 or the opacity according to ISO 2471 of the printed or unprinted area will often be difficult. Thus, in order to determine these values securely, sufficiently large test areas at a different position on the cigarette paper can be provided and utilized for the measurement, for example, sufficiently large areas printed over the entire surface. The same holds for sufficiently large completely untreated areas, which can be left free separately on the cigarette paper, as the case may be. In both cases it can be assumed that these fully printed areas or completely unprinted areas are representative of the whiteness and opacity of the printed and unprinted areas, respectively, of the actual pattern.

Preferably, the opacity according to ISO 2471 of the cigarette paper without application of the composition is at most 90%, preferably at most 80%. For opacities below these limits a particularly good effect is obtained by applying the pattern according to the invention, as in this case, the visual inhomogeneity due to the translucence of the tobacco rod is particularly pronounced. At the same time, the opacity of the untreated cigarette paper should be at least 50%, since for lower opacities, again by application of the patterns according to the invention, a satisfactory appearance can only be obtained with difficulty.

Preferably, the opacity according to ISO 2471 of an area of the cigarette paper onto which the composition has been applied over the full surface is at least 80%, preferably at least 85% and particularly preferably at least 90%. The higher the opacity of the printed area, the better is the effect according to the invention.

In an advantageous embodiment, the whiteness of the cigarette paper according to ISO 2470-1 without application of the composition is at least 80% and particularly between 80% and 95%. Particularly good results can be obtained for these values of whiteness.

In an advantageous embodiment, the fraction of the printed area on the treated area, according to the above definition, is less than 80%, preferably less than 70% and particularly preferably less than 50%. It should be noted that this ratio is an additional property of the pattern which, apart from the coarseness, has an independent meaning. In many cases it is advantageous to prefer those patterns for a given coarseness for which the fraction of the printed area with respect to the treated area is small, in order to affect the air permeability and diffusion capacity of the paper as little as possible.

Preferably the fraction of the treated area with respect to the entire visible cigarette paper area of the cigarette paper is at least 20%, preferably at least 50% and particularly preferably at least 70%. In particularly preferred embodiments, however, the treated area will extend over the entire visible cigarette paper area, in order to obtain the desired effect on it.

The composition comprises at least water, as the solvent, and a colorant. Further, the composition should be water-based, which means that it in any case it contains less than 10% by weight, preferably less than 5% by weight of organic solvents, referred to the weight of the composition. The composition in this case can preferably be formed by a solution, a suspension or an emulsion. The term "solvent" should not indicate that the composition is a "solution" in the strict sense. Actually, a suspension of the colorant is preferred as the composition.

The use of a water-based composition implies that after drying, no or at best very small amounts of organic solvent remain on the printed area, preferably less than 0.5 $mg/m^2$, particularly preferably less than 0.1 $mg/m^2$, respectively referred to the printed area.

Preferably, the solvent is formed by water alone. The advantage of organic solvents consists in that they can mostly be removed with less energy input after application of the composition than water, but small residual quantities of organic solvent remain on the cigarette paper, which can have a negative effect on the aroma of the cigarette, particularly directly after opening the cigarette pack. Furthermore, there are toxicological concerns regarding the use of organic solvents in cigarette paper. Thus, water is the preferred solvent.

Any colorant can be used as a colorant which, in small quantities, can bring about the desired difference in whiteness between the printed and unprinted area. In this regard, toxicological and legal aspects are to be considered above all. Light-fastness and possible bleeding of the colorant in the presence of humidity can be taken into consideration as well. For white cigarette paper, carbon particles of medical carbon are a particularly preferred colorant; likewise, black, water-soluble food colorants which usually fulfill the legal requirements and are easier to disperse than medical carbon are also preferred. Alternatively, for white cigarette paper organic colorants, for example blue E132, or inorganic pigment colorants can be used.

For coloured cigarette papers there is often less need to apply the invention, but basically it can be used in this case as well. In this case, colorants have to be used which correspond in their colour shade to the cigarette paper, as for example, inorganic pigment colorant, for example, iron oxides (E172), organic colorants such as blue E132, red E123 or red E124, or mixtures thereof In a further advantageous embodiment, the composition contains at least one binder, particularly one or more binders, which is(are) selected from the following group: cellulose derivatives; starch and starch derivatives, particularly dextrins and maltodextrins; modified starch, particularly oxidized starch, acetylated starch, or cationic starch; phosphated starch; guar; gum Arabic; agar agar; sugars, particularly fructoses; mannoses, maltoses or molasses; sugar alcohols, particularly sorbitol or mannitol; polyvinyl alcohol; polyvinyl acetate; gelatin; carboxymethyl starch.

Preferably, at least 0.1% by weight, particularly preferably at least 0.3% by weight and/or at most 7.0% by weight, preferably at most 5.0% by weight of the composition is formed by the colorant.

Further, preferably at most 25% by weight of the composition, particularly preferably 1.0% by weight to 20.0% by weight is formed by the binder. In this regard, the binder and its quantity can be used to adjust the viscosity of the composition required for the application process.

The applied quantity of the composition is preferably at least 0.1 $g/m^2$, particularly preferably at least 0.3 $g/m^2$. It should, however, be at most 2.0 $g/m^2$, preferably at most 1.5 $g/m^2$, respectively referred to the mass of dried composition and per square meter of printed area. Such application quantities will in practice suffice to achieve the desired whiteness and opacity in the printed area, but at the same time avoid too great a change in further technical properties, particularly the air permeability and the diffusion capacity of the cigarette paper.

Preferably, the basis weight of the cigarette paper in the untreated state is at least 10 $g/m^2$ and/or at most 60 $g/m^2$, preferably at most 35 $g/m^2$ and particularly preferably at most 28 $g/m^2$. The invention exhibits particularly good effects for cigarette papers with comparatively small basis weights between 20 $g/m^2$ and 28 $g/m^2$, for which the opacity in the untreated state is comparatively low and the inhomogeneities in the opacity becomes strongly noticeable. In an advantageous embodiment, the cigarette paper further contains at least one inorganic, mineral filler which is added to the paper in a fraction by weight of at least 10% by weight, preferably at least 15% by weight and/or at most 45% by weight, preferably at most 35% by weight and particularly preferably at most 25% by weight, respectively referred to the cigarette paper without application of the composition. Again, particularly good effects can be obtained for a comparatively low filler content of, for example 15% by weight to 25% by weight, for which the whiteness and opacity of the untreated cigarette is as a rule comparatively low, so that these cigarette papers have a tendency to exhibit visual inhomogeneities in the initially described manner.

In this regard, the filler is preferably formed by calcium carbonate (chalk) or other carbonates or oxides, particularly magnesium oxide, magnesium hydroxide or aluminum hydroxide or mixtures thereof Further, the cigarette paper preferably comprises substances which increase or reduce the smouldering speed of the paper, particularly tri-sodium citrate, tri-potassium citrate or mixtures thereof, whereby the fraction of these substances, however, preferably does not exceed 5% by weight of the paper weight.

In a further advantageous embodiment, the air permeability of the treated area is at least 10 CU, preferably at least 20 CU and/or at most 150 CU, preferably at most 130 CU. Such air permeabilities are also common for conventional cigarette papers. An essential advantage of the invention, however, consists in that such air permeabilities can also be obtained in the treated area, that is, in spite of the application of the composition.

In an advantageous embodiment, the diffusion capacity of the treated area for $CO_2$ is at least 0.01 cm/s and/or at most 3.5 cm/s, preferably at most 3.0 cm/s. Again, these are common diffusion capacities which, however, can also be obtained in the context of the invention in the treated area.

In a further aspect, the invention relates to a process for the manufacture of a cigarette paper according to one of the embodiments described above. In the process, a water-based composition is printed to form said patterns, preferably by gravure printing, by offset- or flexographic printing, or sprayed. Application by gravure printing is particularly preferred as it is particularly well suited with respect to flexibility, speed and quality to applying the composition in the process of the invention.

The invention further relates to a cigarette comprising a tobacco rod and a cigarette paper according to one of the embodiments described above, which wraps the tobacco rod. In this regard, the fraction of the treated area with respect to the visible cigarette paper area is at least 20%, preferably at least 50% and particularly preferably at least 70%. In preferred embodiments, however, the entire visible cigarette paper area can be formed as a treated area.

Additionally or alternatively, the pattern is repeated and the circumference of the cigarette is an integer multiple of the repeat of the pattern in the circumferential direction. Thus, this ensures that the pattern continues sufficiently in the area of the adhesive seam, where the cigarette paper overlaps with itself, whereby the effect according to the invention can also be obtained in the area of the adhesive seam of the cigarette paper.

BRIEF DESCRIPTION OF THE FIGURES

FIG. 7 shows a table in which the characteristic parameters a, b and, if applicable, c, the coarseness and the coverage of 27 examples, according to and not according to the invention, are summarized, which are based on six different pattern types according to FIG. 1-6.

DESCRIPTION OF THE PREFERRED EMBODIMENTS

Figure 1:
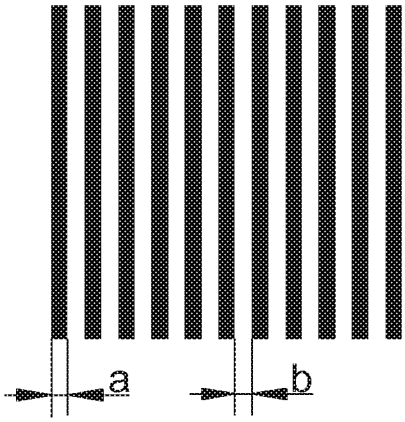
FIG. 1-6 show various patterns which, for a certain choice of the geometrical parameters a, b and c, can produce the effect according to the invention.
Figure 2:
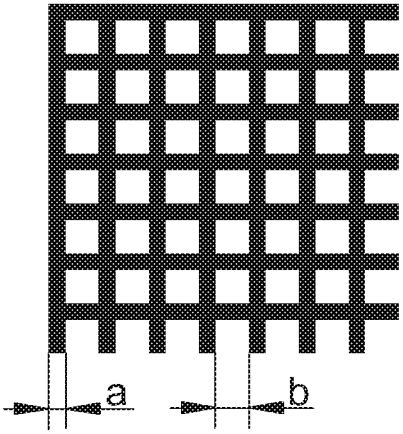
Figure 3:
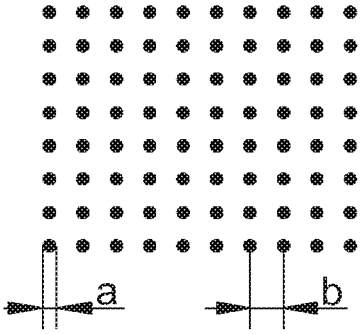
Figure 4:
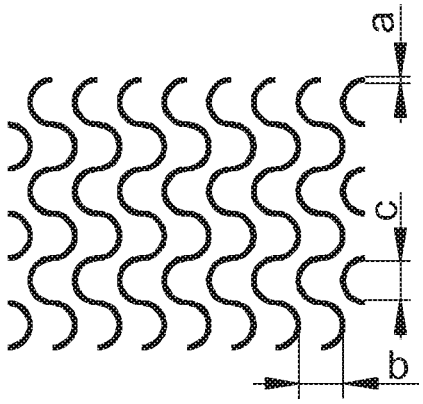
Figure 5:
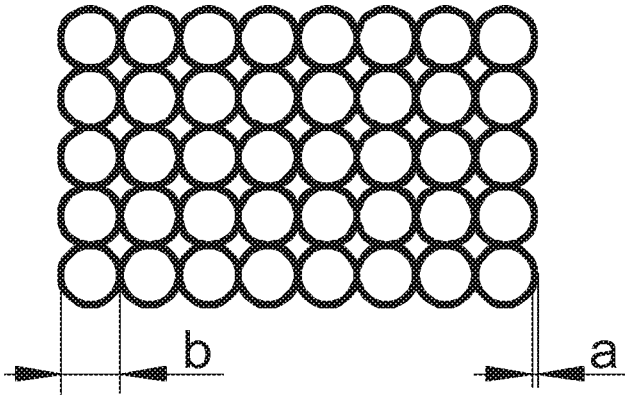
Figure 6:
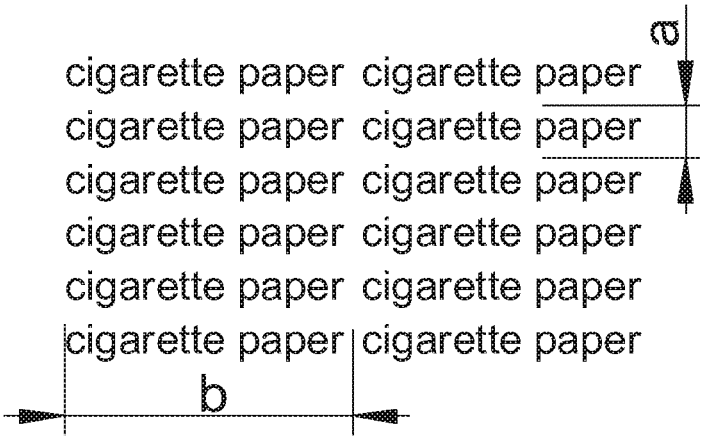

The inventors have tested the invention by means of six different patterns which are shown in FIGS. 1 to 6. In FIGS. 1 to 6 the parameters a, b and, if applicable, c are shown, which represent characteristic dimensions of the respective pattern. The Tamura coarseness can be calculated as a function of these parameters, as explained in the summary of the invention. Further, the "coverage" of the pattern can be calculated, which indicates the fraction of the printed area with respect to the treated area, and is thus expressed as a percentage. It should be noted that the coarseness as well as the coverage are independent of the respective whiteness of the printed and unprinted area according to ISO 2470-1.

Table 1 of FIG. 7 shows the coarseness and the coverage for various parameter values a, b and, if applicable, c for the various patterns of FIGS. 1 to 6. Corresponding cigarette papers were manufactured, for which the whiteness of the cigarette paper according to ISO 2470-1 was between 80 and 90% and the opacity between 70 and 80%. The whiteness of a full-surface printed area was about 40% less than that of the untreated area. The opacity of the printed area measured according to ISO 2471 was thus always higher than the opacity of the untreated area.

Cigarettes were manufactured from the printed papers; their visual appearance was compared with that of a cigarette from an identical but untreated cigarette paper. In this regard, it was found that, at least approximately independently of the specific design of the pattern, a substantial improvement in the visual homogeneity can be obtained if its coarseness is chosen so as to be sufficiently low. Good results were obtained for a coarseness below 0.22 mm, wherein the visual impression improved further at an even lower coarseness of 0.20 mm. This effect is apparent to a person skilled in the assessment of paper formation, but it can hardly be documented metrologically otherwise, as it relies on human sensory perception. In fact, the visual homogeneity, if one wanted to quantify it, is not increased in reality, but the finely structured pattern somehow artificially reduces it. The visual impression which results for the human observer and on which it depends solely for the purpose of the invention is surprisingly such that the paper appears more homogeneous for a plurality of different patterns with a coarseness which falls below 0.22 mm.

It has specifically been shown that the desired effect for the patterns of examples 1, 2, 3, 8, 9, 10, 15, 19, 22, 24 and 27 according to the table of FIG. 7 appears particularly intense, while the effect according to the invention for the patterns of examples 4, 5, 6, 7, 11, 12, 13, 14, 17, 18, 20, 21, 23, 25 and 26 could hardly be obtained. The reason for this is that the structures were too large and the unwanted inhomogeneities still remained visible. Pattern 16 showed at least satisfactory results. Although it is to be expected that the results could be further improved by the choice of a very low coarseness, technological limits of some printing processes are reached for patterns with a coarseness of below approximately 0.01-0.05 mm.

Further, it could be confirmed that the patterns according to the invention could be applied without having a further negative effect on the technical properties of the paper. For example, an aqueous printing solution with 1.5% by weight of Blanose® MCF-7 sodium carboxy methyl cellulose and 1.4% by weight of medical carbon was printed onto a cigarette paper with a basis weight of 27 g/m$^2$, a chalk content of 28% by weight, a whiteness of 87%, an opacity of 75%, an air permeability of 72 CU and a diffusion capacity of 2.73 cm/s in a gravure printing process. The pattern selected was that of example 27 of table 1. This pattern corresponds to the pattern of FIG. 1.

The whiteness of the printed area, measured according to ISO 2470-1, on a separate, sufficiently large full-surface printed area was 44.6%, and hence was 42.4% lower than that of an untreated area. The opacity of the printed area, measured according to ISO 2471 on the same area as for the whiteness, was 93.5% and hence was 18.5% higher than the opacity of the untreated area. A comparison of the visual impression of the printed and unprinted cigarette paper by a skilled person experienced in the assessment of paper formation in fact exhibited a reduction in whiteness, but a substantial improvement in the visual homogeneity. The measurement of the air permeability according to ISO 2965 with a measurement head with an opening of 10×20 mm, which was located entirely on the treated area, gave a value of 67.5 CU and thus only a slight reduction of 4.5 CU compared with the untreated area.

The measurement of the diffusion capacity with a $CO_2$ Diffusivity Meter from Sodim after conditioning of the paper according to ISO 187 and with a measurement head with an opening of 4×20 mm which was fully located on the treated area gave a value of 2.60 cm/s and hence only a slight reduction of 0.13 cm/s compared to the untreated area. Thus, the invention can be implemented to the greatest possible extent without having a negative effect on the essential technical properties of the cigarette paper.

The invention claimed is:

1. Cigarette paper, to which a composition is applied in form of a pattern, which has a Tamura coarseness of at most 0.22 mm, wherein an absolute difference in the whiteness according to ISO 2470-1 between an area of the cigarette paper to which the composition has been applied and an area of the cigarette paper to which the composition has not been applied, is in the dried state of the composition, at least 25%, and at most 60%, and wherein an opacity according to ISO 2471 of an area of the cigarette paper to which this composition has been applied is, in the dried state of the composition, higher than the opacity of an area to which this composition has not been applied.

2. Cigarette paper according to claim 1, wherein the Tamura coarseness of the pattern is at least 0.01 mm.

3. Cigarette paper according to claim 1, wherein the area of the cigarette paper to which the composition is not applied has a whiteness according to ISO 2470-1 of less than 95% or an opacity according to ISO 2471 of less than 90%.

4. Cigarette paper according to claim 1, wherein the opacity according to ISO 2471 of the cigarette paper without application of the composition is at most 90% and at least 50%.

5. Cigarette paper according to claim 1, wherein the opacity according to ISO 2471 of an area of the cigarette paper to which the composition has been applied is, in the dried state of the composition, at least 80%.

6. Cigarette paper according to claim 1, wherein the whiteness according to ISO 2470-1 of the cigarette paper without application of the composition is at least 80%.

7. Cigarette paper according to claim 1, wherein the fraction of a printed area with respect to a treated area is less than 80%, wherein the "printed area" should be taken to be that area of the cigarette paper to which the composition was applied—independently of the actually used application process—, and the "treated area" is defined as the printed area supplemented by a virtual edge around the printed area with a width of 1.5 mm.

8. Cigarette paper according to claim 1, wherein the fraction of a treated area with respect to the entire visible area of the cigarette paper is at least 20%, wherein the "treated area" is defined as a printed area supplemented by a virtual edge around the printed area with a width of 1.5 mm and the "printed area" should be taken to be that area of the cigarette paper to which the composition was applied—independently of the actually used application process.

9. Cigarette paper according to claim 1, wherein the composition comprises at least water and a colorant, wherein the composition is preferably formed by an aqueous solution, suspension or emulsion, wherein the colorant is at least partially formed by one of carbon particles, medical carbon, a black water-soluble food colorant, an inorganic pigment, an organic colorant or a mixture of at least two of these colorants.

10. Cigarette paper according to claim 9, wherein the composition further contains one or more binders selected from the group of: cellulose derivatives; starch and starch derivatives; modified starch; phosphated starch; guar; gum Arabic; agar agar; sugars; sugar alcohols; polyvinyl alcohol; polyvinyl acetate; gelatin; and carboxymethyl starch.

11. Cigarette paper according to claim 9, wherein at least 0.1% by weight and at most 7.0% by weight of the composition is formed by the colorant, and wherein at most 25.0% by weight of the composition is formed by a binder.

12. Cigarette paper according to claim 9, wherein the applied quantity of the composition is at least 0.1 g/m$^2$ and at most 2.0 g/m$^2$ with respect to the mass of dried composition and per square meter of a printed area, wherein the "printed area" should be taken to be that area of the cigarette paper to which the composition was applied—independently of the actually used application process.

13. Cigarette paper according to claim 1, with a basis weight in the untreated state of at least 10 g/m$^2$ and at most 60 g/m$^2$.

14. Cigarette paper according to claim 1, which further contains at least one inorganic mineral filler which is added to the paper in a fraction by weight of at least 10% and at most 45%, each with respect to the cigarette paper without application of the composition, wherein the filler is preferably formed by calcium carbonate or other carbonates or oxides, magnesium hydroxide or aluminum hydroxide or mixtures thereof.

15. Cigarette paper according to claim 1, in which the air permeability of the treated area is at least 10 CU and at most 150 CU, wherein the "treated area" is defined as a printed area supplemented by a virtual edge around the printed area with a width of 1.5 mm, and the "printed area" should be taken to be that area of the cigarette paper to which the composition was applied—independently of the actually used application process.

16. Cigarette paper according to claim 1, for which the diffusion capacity of a treated area for $CO_2$ is at least 0.01 cm/s and at most 3.5 cm/s, wherein the "treated area" is defined as a printed area supplemented by a virtual edge around the printed area with a width of 1.5 mm, and the "printed area" should be taken to be that area of the cigarette paper to which the composition was applied—independently of the actually used application process.

17. A process for manufacturing a cigarette paper comprising the following steps:

providing a base paper, and applying a water-based composition to form a pattern on said base paper, said pattern having a Tamura coarseness of at most 0.22 mm, wherein by applying the aqueous composition, the opacity according to ISO 2471 is increased and the whiteness according to ISO 2470-1 is reduced such that the absolute difference in whiteness according to ISO 2470-1 between an area of the cigarette paper to which the composition has been applied and an area of the cigarette paper to which the composition has not been applied is, in the dried state of the composition, at least 25%, and at most 60%.

18. The process according to claim 17, wherein the composition is applied by gravure printing, offset—or flexographic printing or spraying.

19. A cigarette comprising a tobacco rod and a cigarette paper which wraps the tobacco rod, wherein to the cigarette paper a composition is applied in form of a pattern, which has a Tamura coarseness of at most 0.22 mm, wherein the absolute difference in the whiteness according to ISO 2470-1 between an area of the cigarette paper to which the composition has been applied and an area of the cigarette paper to which the composition has not been applied is, in the dried state of the composition, at least 25%, and at most 60%, and wherein the opacity according to ISO 2471 of an area of the cigarette paper to which this composition has been applied is, in the dried state of the composition, higher than the opacity of an area to which this composition has not been applied, wherein the fraction of a treated area with respect to the visible area of the cigarette is at least 20% wherein a "treated area" is defined as a printed area supplemented by a virtual edge around the printed area with a width of 1.5 mm, and the "printed area" should be taken to be that area of the cigarette paper to which the composition was applied—independently of the actually used application process.

20. Cigarette paper according to claim 1, wherein said pattern has a Tamura coarseness of at most 0.20 mm.

21. Cigarette paper according to claim 1, wherein said absolute difference in the whiteness according to ISO 2470-1 between an area of the cigarette paper to which the composition has been applied and an area of the cigarette paper to which the composition has not been applied is, in the dried state of the composition, at least 35%.

22. Cigarette paper according to claim 1, wherein said absolute difference in the whiteness according to ISO 2470-1 between an area of the cigarette paper to which the composition has been applied and an area of the cigarette paper to which the composition has not been applied is, in the dried state of the composition, at least 40%.

23. Cigarette paper according to claim 1, wherein said absolute difference in the whiteness according to ISO 2470-1 between an area of the cigarette paper to which the composition has been applied and an area of the cigarette paper to which the composition has not been applied is, in the dried state of the composition, at most 55%.

24. Cigarette paper according to claim 1, wherein the Tamura coarseness of the pattern is at least 0.05 mm.

25. Cigarette paper according to claim 9, wherein at least 0.1% by weight and at most 7.0% by weight of the composition is formed by the colorant.

26. Cigarette paper according to claim 10, wherein at most 25.0% by weight of the composition is formed by the binder.

27. Cigarette paper according to claim 1, wherein the opacity according to ISO 2471 of the cigarette paper without application of the composition is at most 90% and at least 50%.

28. Cigarette paper according to claim 1, with a basis weight in the untreated state of at least 10 $g/m^2$ and at most 60 $g/m^2$.

29. Cigarette paper according to claim 1, which further contains at least one inorganic mineral filler which is added to the paper in a fraction by weight of at least 10% and at most 45%, each with respect to the cigarette paper without application of the composition, wherein the filler is preferably formed by calcium carbonate or other carbonates or oxides, magnesium hydroxide or aluminum hydroxide or mixtures thereof.

30. Cigarette paper according to claim 1, in which the air permeability of the treated area is at least 10 CU and at most 150 CU, wherein the "treated area" is defined as a printed area supplemented by a virtual edge around the printed area with a width of 1.5 mm, and the "printed area" should be taken to be that area of the cigarette paper to which the composition was applied—independently of the actually used application process.

31. Cigarette paper according to claim 1, for which the diffusion capacity of a treated area for $CO_2$ is at least 0.01 cm/s and at most 3.5 cm/s, wherein the "treated area" is defined as a printed area supplemented by a virtual edge around the printed area with a width of 1.5 mm, and the "printed area" should be taken to be that area of the cigarette paper to which the composition was applied—independently of the actually used application process.

32. A cigarette comprising a tobacco rod and a cigarette paper which wraps the tobacco rod, wherein to the cigarette paper a composition is applied in form of a pattern, which has a Tamura coarseness of at most 0.22 mm, wherein the absolute difference in the whiteness according to ISO 2470-1 between an area of the cigarette paper to which the composition has been applied and an area of the cigarette paper to which the composition has not been applied is, in the dried state of the composition, at least 25%, and at most 60%, and wherein the opacity according to ISO 2471 of an area of the cigarette paper to which this composition has been applied is, in the dried state of the composition, higher than the opacity of an area to which this composition has not been applied, wherein the pattern is periodically repeated and the circumference of the cigarette is an integral multiple of the repeat of the pattern in the circumferential direction.

33. A cigarette comprising a tobacco rod and a cigarette paper which wraps the tobacco rod, wherein to the cigarette paper a composition is applied in form of a pattern, which has a Tamura coarseness of at most 0.22 mm, wherein the absolute difference in the whiteness according to ISO 2470-1 between an area of the cigarette paper to which the composition has been applied and an area of the cigarette paper to which the composition has not been applied is, in the dried state of the composition, at least 25%, and at most 60%, and wherein the opacity according to ISO 2471 of an area of the cigarette paper to which this composition has been applied is, in the dried state of the composition, higher than the opacity of an area to which this composition has not been applied, wherein the fraction of a treated area with respect to the visible area of the cigarette is at least 20% wherein a "treated area" is defined as a printed area supplemented by a virtual edge around the printed area with a width of 1.5 mm, and the "printed area" should be taken to be that area of the cigarette paper to which the composition was applied—independently of the actually used application process, and wherein the pattern is periodically repeated and the circumference of the cigarette is an integral multiple of the repeat of the pattern in the circumferential direction.

* * * * *